United States Patent [19]

Wattenburg et al.

[11] Patent Number: 4,629,357

[45] Date of Patent: Dec. 16, 1986

[54] MOVABLE BARRIER

[76] Inventors: Willard H. Wattenburg; Eric J. Wattenburg, both of Box 316, Greenville, Calif. 95947

[21] Appl. No.: 609,710

[22] Filed: May 14, 1984

[51] Int. Cl.[4] ..... E01F 15/00

[52] U.S. Cl. ..... 404/6; 404/9; 404/13; 256/13.1; 285/261

[58] Field of Search ..... 404/6, 9–13; 256/1, 13.1; 285/118, 261, 264

[56] References Cited

U.S. PATENT DOCUMENTS 2,927,513 3/1960 Dove ..... 404/6 X
3,002,269 10/1961 Hopkins ..... 285/261
3,245,327 4/1966 Wasley ..... 404/12
4,062,521 12/1977 Moreau ..... 256/1

FOREIGN PATENT DOCUMENTS 1808212 5/1970 Fed. Rep. of Germany ..... 256/13.1

*Primary Examiner*—James A. Leppink
*Assistant Examiner*—John F. Letchford
*Attorney, Agent, or Firm*—Flehr, Hohbach, Test, Albritton & Herbert

[57] ABSTRACT

A movable traffic barrier for dividing adjacent lanes of traffic in a roadway which includes a number of hollow cylindrical barriers laid end to end and projecting above the roadway, and a cable for rotating said cylindrical barriers to position them on the roadway.

7 Claims, 12 Drawing Figures

MOVABLE BARRIER

The present invention relates generally to a movable barrier, and more particularly to a highway traffic control system incorporating a movable barier as a traffic lane divider.

More major urban areas are faced with the problem that large number of people work in a downtown or core area, and live in suburban areas, commuting back and forth by cars. It therefore becomes necessary, rather than providing sufficient traffic lanes to handle the traffic flow in either direction, to provide "reversible lanes". That is, on a highway having a limited number of lanes running between the downtown core and the suburban areas, a majority of the lanes would be devoted to the direction of traffic flow into the core during peak travel hours in that direction with only a minority reserved for traffic flow out of the core. When the majority traffic flow is in the opposite direction, then the proportion of lanes devoted to that flow is also reversed. In the intermediate hours, the lanes devoted to traffic in each direction is balanced.

In order to provide for this balancing effect, it is apparent that some sort of barrier must be provided between the traffic flowing in opposite directions. The traffic flow is at such high speed, and the cars moving in opposite directions so close together, that in the absence of such a barrier some sort of major accident at all to frequent intervals is almost inevitable.

It is therefore, an object of the present invention to provide a new and improved movable barrier.

It is a second object of the present invention to provide a apparatus especially adapted for use in dividing lanes in a roadway.

A prior attempt in this area represented by a patent to Moreau U.S. Pat. No. 4,062,521 which uses a number of modules coupled together in a line. The modules, however are designed to disintegrate or burst under impact. Therefore, such a system is difficult to maintain, and is not effectively movable.

A similar desing in a patent to Guzzardela U.S. Pat. No. 3,540,699 discloses highway barriers filled with fluid; such barriers are also difficult if not impossible to move. A movable barrier apparatus for a roadway is disclosed in a patent to Eschen U.S. Pat. No. 4,004,857; however, the barrier material is a flat metal ribbon or the like, which is expensive both to put in place, and to repair after damage due to impact by a moving vehicle. Further, the means for changing the position of the barrier comprises a hydraulic ram mounted underneath the roadway, a form of construction which is also expensive to install and maintain. Another approach to construction of a movable barrier is disclosed in a patent to Mahoney U.S. Pat. No. 3,391,620. This patent which is directed to means for moving hollow barriers across a roadway utilizes a belt and sprocket combination which would also pose some difficulty in maintenance as well as not being well adapted to moving dividers of considerable inertia or holding them in place in the manner which is required to provide an effectively functioning lane barrier.

It is an objective of the present invention to provide a roadway barrier which can be relatively easily moved from one position to another to divide the lanes of a roadway.

It is another objective of the present invention to provide a roadway barrier which is of relatively inexpensive construction to minimize the cost thereof.

It is a further objective of the present invention to provide a barrier which while effectively preventing vehicles from crossing into lanes of the roadway carrying traffic in the opposite direction and does not cause excessive damage to such vehicles impacting the barrier while at the same time re-directing such vehicles smoothly back into the adjacent traffic lane.

Yet another objective of the present invention is to provide a movable barrier which can be installed relatively easily on an existing roadway.

Yet another objective of the present invention is to provide a barrier which depending on the actual mode of installation can be moved either by the direct application or mechanical or alternatively by permanently placed moving means imbedded in the roadway and actuated by remote control.

The above and other objectives of the present invention are achieved by a movable barrier comprising in a preferred form a series of steel pipes arranged end to end, and connected together by appropriate joining means to prevent their being moved out of alignment under sudden heavy impact. In a preferred form, such joining means are adapted to allow for some angular movement of adjacent barrier sections, so that the barriers can be moved from one position to another as desired on curved roadways. The moving means may include a truck or the like suitably modified to move the barriers while driving in a direction substantially parallel to the barriers. Alternatively, when the barrier is permanently mounted in a roadway or the like, a cable-trolley mechanism can be provided underneath the barrier for passing a cable over the barrier laterally (preferably at the point of joinder between adjacent sections of the barrier), the trolley being movable in a slot beneath the roadway. Movement of the trolley laterally would in turn cause movement of the cable over the barrier, and lateral rotation of the round barrier to move it from place to place. The use of such a cable-trolley moving mechanism also ties the barrier down to the roadway when the barrier is not to be moved. Use of round barrier section also allows the sections to be resting in place on the roadway in grooves cut in the roadway.

These and other objectives of the present invention will be more clearly apparent from a study of the following detailed specification and figures wherein.

Figure 10A:
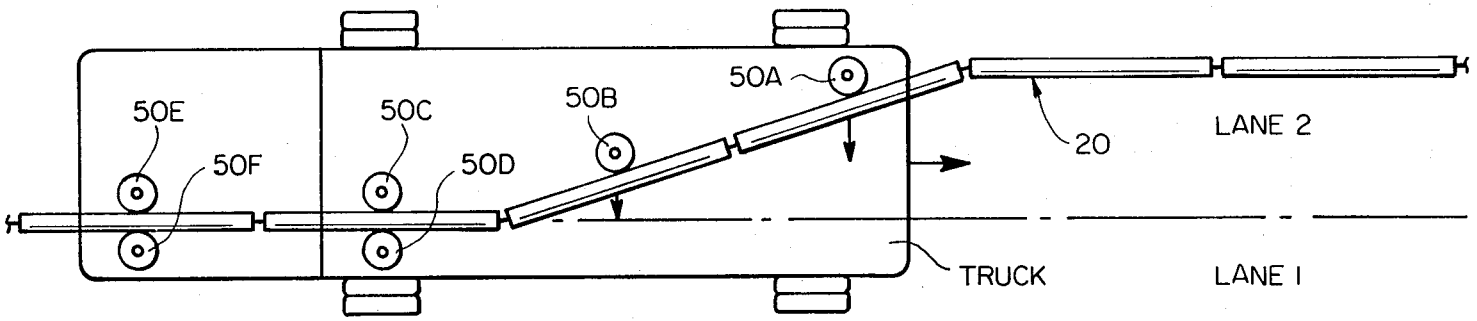
Figure 10B:
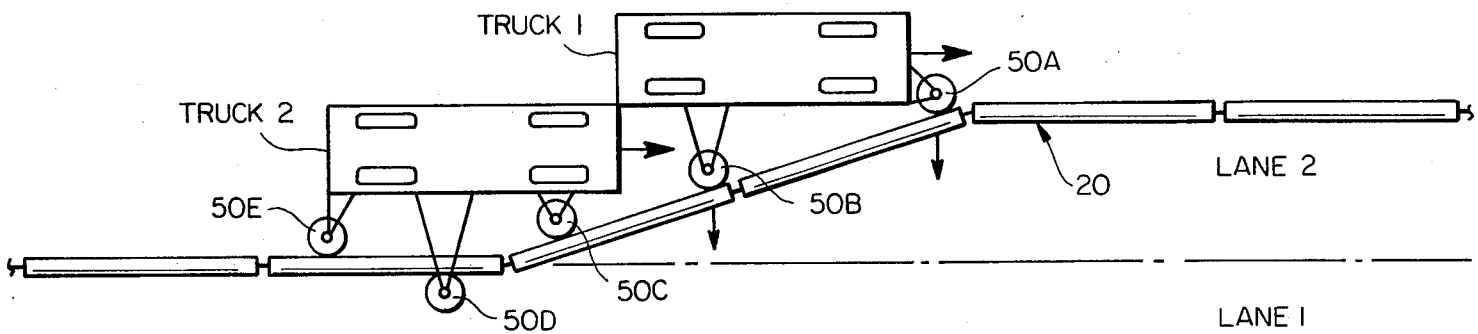

FIGS. 10*a* and 10*b* illustrate diagrammatically two alternative types of trucks which may be used to shove a barrier from a first desired position to a second desired position.

The invention described in this application is useful for providing a barrier in a number of environments such as pedestrian control in crowded areas, or as a barrier against entry of undesired vehicles, as for example around a secure installation against terrorist attack.

A preferred form of the invention is for controlling vehicle traffic along roadways such as highways and especially across bridges which typically have no existing median strip but which have limited capacity and increasing demands for use. Thus the invention in the form described below is in many instances described with respect to its use on a highway or bridge but is adaptable to other uses.

Figure 1:
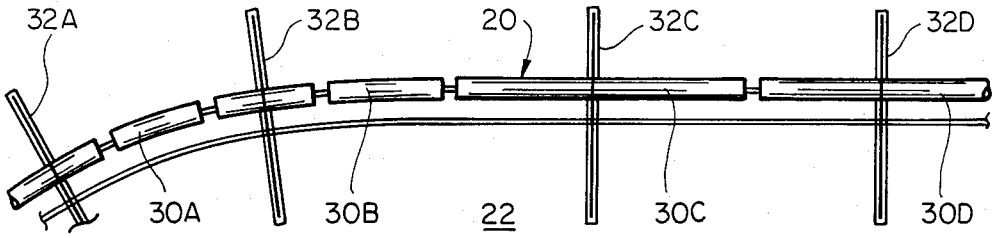
FIG. 1 shows diagrammatically a safety barrier in place on a roadway.

The barrier apparatus shown diagrammatically in FIG. 1 includes a divider or barrier 20 extending longitudinally along a roadway 22 and projecting above the normal height of the roadway by the full height of the steel pipe. A number of spaced members 30 A, B, C, D . . . form the barrier. The separate segments of the barrier are moved transversely with respect to the roadway either by a specially adapted truck such as shown in FIG. 10, or by a trolley movable along tracks 32 as shown schematically in FIG. 1 and in greater detail in FIG. 2. It has been found that in a preferred embodiment, the shorter segments used to go around a curve should be approximately 20 to 40 feet long; the segments on the straight portion can be 100 to 300 feet long. Some motor power means should be associated with each of the longer segments as shown by the raceways 32C and 32D of FIG. 1. It is possible that when moving a barrier on a curve that a raceway only need be used for alternate segments.

It has been found that the strength of a barrier as shown in FIG. 1 to a 90° impact is 10 to 20 times that of ¾ inch steel cable such as used today in many freeway divider barriers. For the preferred height of 24" the barrier weight is 60 to 150 pounds per foot, depending on wall thickness (⅜" to 1.0"). If greater inertia is desired, the shell may be filled with loose fill material or liquid such as water to substantially increase its mass and provide much greater energy absorption upon impact.

It has been shown that a 50 foot section of 24" diameter, ⅜" thick standard steel pipe will deflect a maximum of 13" (momentarily, elastically) with minor denting when struck by a 60 mph, 4500 lb., car at 25° angle. The denting absorbs substantial energy, and is desirable, the car is redirected into and along the adjacent lane with much less loss of control (violent roll and yaw) than when the same car strikes a standard, rigid concrete barrier.

Figure 2:
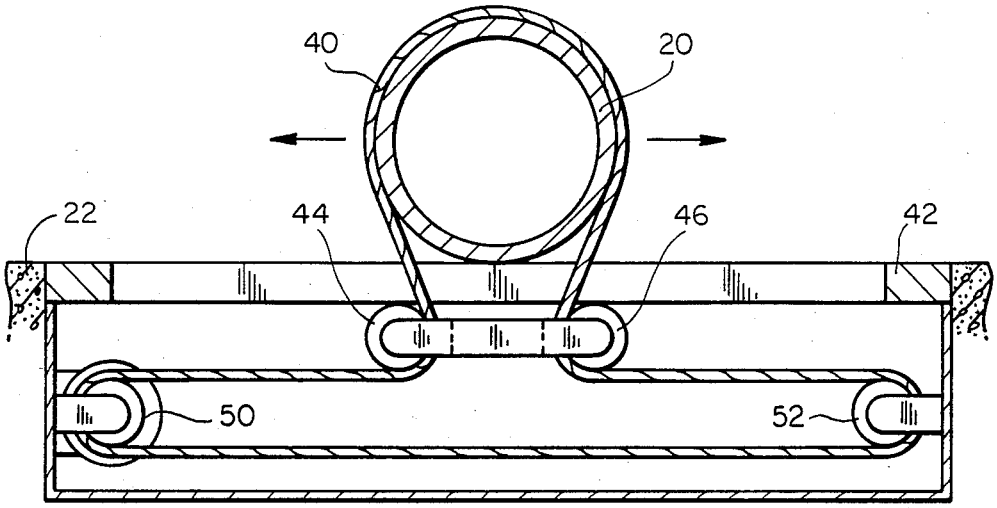
FIG. 2 shows a cable trolley moving mechanism, the trolley being located in a slot beneath the roadway.

The hollow shells provide a barrier of sufficient height to prevent colliding vehicles from climbing over the top of the barrier. The use of round barriers also facilitates moving the barriers by simply rolling from one position to another. For example, referring again to FIG. 1, grooves may be cut in the roadway 22 to define each of a plurality of positions where the barrier may come to rest. Therefore, the cable and truss which is used to move the pipe barrier, is aided in holding the barrier still by use of these grooves. As for the motor means for moving the barrier from one position to another in a preferred form of the invention they are shown in FIG. 2. The motor means are disposed generally below the roadway in a channel, and thus are especially useful in mounting the system on a bridge at the like.

Figure 3:
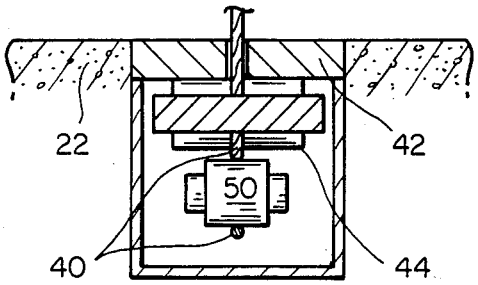
FIG. 3 is a cross-sectional view of significant detail of the cable-trolley mechanism shown in FIG. 2.

In this system, a raceway with a system inside it comprising a cable and trolley truss and power winch shown in FIGS. 2 and 3 is utilized. The cable 40 passes up and around the barrier through a continuous slot in the top of the raceway which need be only approximately ¾ inch wide. The trolley itself rolls on the underside of a raceway plate 42 which can bear the stress of the upward pressure of the trolley. The trolley itself comprises two rollers 44, 46 fastened together by cross pieces 48 to maintain the pressure on the cable 40 in order that it can grip the pipe barrier by friction. Power is supplied by the winch 50 and a return roller 52 is provided to complete the cable loop. Applying power to the power winch 50 will drive the cable in either direction and carry the pipe barrier in the desired direction to change the lane format.

Figure 4:
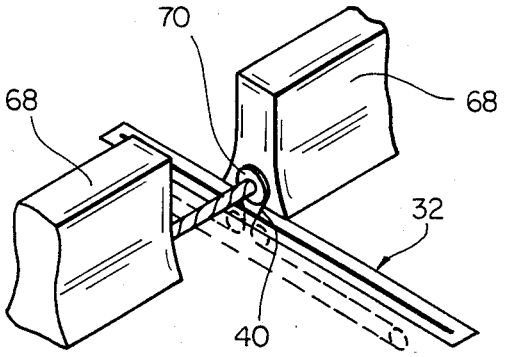
FIG. 4 is an alternative embodiment of the cable-trolley moving mechanism used in combination with an alternative form of barrier.

An alternative embodiment of a cable-trolley barrier is shown in FIG. 4. Here the cable-trolley mechanism is used to move and tie down a concrete barrier. The barriers are of concrete, as already known and in use, but of lighter construction with rollers imbedded in the bottom to facilitate barrier movement over the road bed. By mounting a cable pulley 70 on the end of the barrier segment 68, the segments can be normally structurally stiffened to be held in place. By powering the cable-trolley the barrier can now be moved if necessary.

An alternative method of moving the barriers from lane to lane is shown in FIGS. 10*a* and 10*b*. Here, the cable-trolley mechanism (if used) provides only tie-down of the barrier to the road surface, while barrier movement is provided by a road level vehicle. An unpowered version of FIG. 2 will provide barrier hold down at all times. Both embodiments use a modification of a standard truck design. In the modification of FIG. 10*a*, a plurality of wheels functioning as barrier contact roller and rolling in the horizontal plane are mounted on either side of a channel in the truck. The truck thereby effectively straddles the barrier 20. The pressure of the wheels 50 moves the barrier from one lane to another using the forward horizontal wheels 50A, 50B, and straightens the barrier out along the path of the truck using the rear wheels 50C, 50D, 50E, 50F. Alternatively, a pair of trucks can be used with the wheels 50A, 50B, 50C, 50D, 50E externally mounted. Thus the trucks to perform this function in this variation can simply be easily mechanically constructed modifications of standard truck vehicles which have sufficient motive power to overcome the inertia of the resting barrier.

Figure 5:
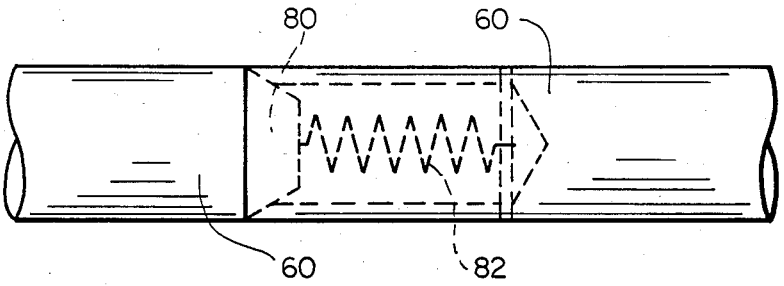
FIG. 5 illustrates one form of joint used to connect adjacent barrier sections.
Figure 6:
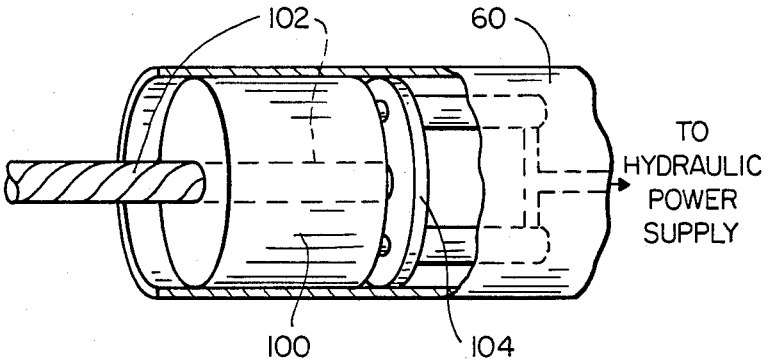
FIG. 6 shows an alternative form of a joint.
Figure 7A:
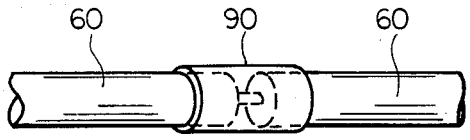
FIG. 7 shows a further alternative form of joint which provides significant added rigidity.
Figure 7B:
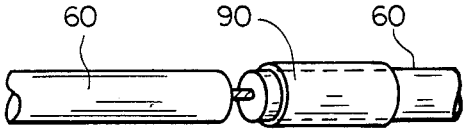
Figure 8:
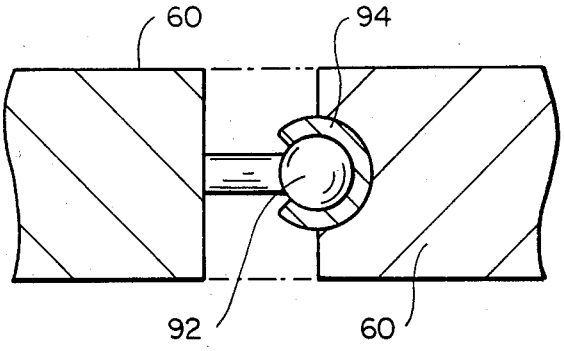
FIG. 8 shows another alternative form of joint.

FIGS. 5–9 show various forms of segment couplers which are useful with the present invention. The segment couplers are to allow for some relative rotation of the barriers segments one relative to the other in the lateral direction so that the barrier can be moved in segments from one longitudinal position to another. The steel spherical ball and socket coupling of FIG. 8 is the preferred form because it provides the greatest longitudinal rigidity (strength) while allowing sufficient lateral bending between segments so that a pipe barrier of many segments can be shoved across lanes progressively as shown in FIGS. 10*a*, and 10*b*. Crash test calculations show (surprisingly) that the greatest force exerted at a joint between two barrier segments, is longitudinal when one barrier segment is impacted in the center. Lateral forces can be restrained by the cable tie-downs. In the embodiment of FIG. 5, one end of the segments 40 is provided with an extended nose section 80. A metal coil spring 82 is coupled to a recessed plate or surface in the confronting end of the adjacent segment. The spring is of sufficient mechanical strength to hold the segments in relative alignment, but allows one segment to move laterally relative to the other.

FIG. 7 illustrates a locking sleeve 90 which is slidable in place over the segment coupling. The sleeve can be slid out of the way during barrier movement, and straddles the joint when the barrier is in place. Any simple form of segment coupling even a cable running through the shells 40 can be used to maintain the relative alignment of the segments.

Alternatively as shown in FIG. 8, a ball 92 and socket 94 would provide the necessary structural rigidity and freedom of lateral movement that is needed for an effective movable barrier. Such a ball and socket arrangement between each segment 40 provides considerable structural rigidity to withstand impacts. In another alternative as shown in FIG. 6, a locking plug can be provided which rests inside each shell 40. The locking plug 100 is slidable along a cable or the like 102, under or in response to the force provided by a hydraulic ram 104. This will lock or stiffen the joint between adjacent segments in between periods of barrier movement. The retraction is simply achieved by the application of hydraulic power.

Figure 9:
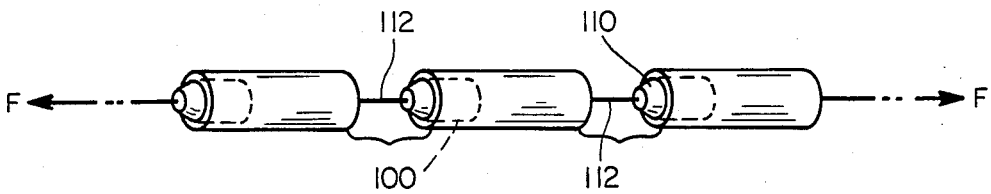
FIG. 9 shows a further alternative form of joint.

An alternative form of the locking plug is shown in FIG. 9 and includes a nose of reduced cross-section 110 on the end of each plug section 100. A single center line cable can be used to actuate a number of these plugs and pull them across the segment coupler space when the barrier is to be locked into position. The cable tends to lend structural rigidity to the barrier when the barrier is in place. An advantage of the locking plug alternative to barrier joint construction is that it allows construction of a movable steel pipe barrier with multiple segments that can be stiffened in place without special tie down mechanisms to lock the bendable joints to the roadway after barrier movement. That is the barrier is flexible with the locking plug retracted to allow easy movement and when the plugs are in place, a rigid continuous piece of pipe is defined.

Such a pipe barrier with locking plugs or sleeves as shown in FIGS. 6, 7, and 9 can be moved from lane to lane by the truck with barrier contract rollers shown in FIG. 10, and then made rigid in place by extending the locking plugs to close the coupling joints between the segments. With this embodiment in place, there is little difference in structural rigidity between the pipe segments and the plugs. The simple actuating mechanisms for the locking plugs can be constructed in a very reliable inexpensive form since they can be slow moving high thrust cylinders. Furthermore even failure of one or a few actuating cylinders will not prevent reasonable barrier movement since the locking plugs can be constructed to be manually retracted by workman with crow bars. This can be accomplished by cutting narrow slots in the outer pipe segments to expose the lock plug surface below its hydraulic cylinder.

Test have shown that smooth steel pipe (18" to 24" diameter) provides much smoother and less traumatic re-direction of errant vehicles which strike it at shallow angles than does a standard concrete median barrier of similar height. The small area, smooth steel contact surface also causes much less damage to cars contacting the barrier at shallow angles than does the high-friction concrete surface of standard median barriers (new Jersey type or Type 50). Most roadways can use long segment length barriers (100' to 300' sections) which are easily moved by rolling. These are much stronger under impact than a moveable concrete barrier which must contain many joints connecting short segments with no means to tie the segments down to the road bed.

Accuracy of rolling the pipe barrier segments from place to place can be further facilitated by putting slightly larger rims on the end of each segment, and cutting a shallow groove in the roadway on which the segments are to move. Other modifications of the preferred embodiment of this invention will become apparent to a person of skill in the art who has studied the above invention disclosure. Therefore, the subject invention is to be limited only as defined by the appended claims.

What is claimed is:

1. A movable traffic barrier for dividing adjacent lines of traffic in a roadway comprising a plurality of hollow cylindrical barrier sections laid end to end along said roadway and projecting above the roadway by their full height, raceways in said roadway perpendicular to the longitudinal axis of said barrier, a cable passing through each of said raceways and over a portion of said barrier, and means for moving said cable to rotate and move said barrier.

2. A traffic barrier as claimed in claim 1 including a powered winch at one end of each of said raceways for driving said cable and a return roller at the other end of said raceway for carrying said cable to allow movement thereof.

3. A barrier as claimed in claim 2 including a trolley movable in said raceway with each of said cables, said trolley rolling on the underside of each raceway.

4. A barrier as claimed in claim 3 wherein each trolley comprises a pair of rollers joined by a truss, the cable passing inside of the rollers and over the barrier section to thereby remain taught against said barrier in order to functionally rotate said barrier and tie down said barrier to the road bed to resist lateral movement under impact.

5. A barrier as claimed in claim 4 including means connecting each of said sections for limited rotational movement.

6. A barrier as claimed in claim 5 wherein an end of one cylindrical section includes a concave portion and the opposing end of the adjacent cylindrical segment includes a convex portion, and including means for coupling the ends of said cylinders.

7. A barrier as claimed in claim 6 wherein said cylindrical sections are filled with loose fill material or liquid such as water to increase the mass of the barrier and absorb the energy of an impacting vehicle.

* * * * *